US005228237A

United States Patent [19]

Nasatka

[11] Patent Number: 5,228,237

[45] Date of Patent: Jul. 20, 1993

[54] VEHICLE BARRIER

[76] Inventor: Ralph G. Nasatka, 8405 Dangerfield Pl., Clinton, Md. 20735

[21] Appl. No.: 920,703

[22] Filed: Jul. 28, 1992

[51] Int. Cl.[5] ..... E01F 13/00

[52] U.S. Cl. ..... 49/49; 49/131; 404/6

[58] Field of Search ..... 49/49, 35, 131; 404/6, 404/9

[56] References Cited

U.S. PATENT DOCUMENTS

| | | | |
|---|---|---|---|
| 3,724,333 | 4/1973 | Fonden et al. | 91/411 |
| 3,854,244 | 12/1974 | Walker | 49/131 |
| 4,152,871 | 5/1979 | Kardash, Jr. | 49/49 |
| 4,356,666 | 11/1982 | Kennedy, III et al. | 49/35 |
| 4,574,523 | 4/1986 | Nasatka | 49/49 |
| 4,630,395 | 12/1986 | Nasatka | 49/49 |
| 4,752,152 | 6/1988 | Crisp et al. | 49/49 X |
| 4,818,136 | 4/1989 | Nasatka et al. | 404/6 |
| 4,822,206 | 4/1989 | Roussel et al. | 404/6 |
| 4,822,207 | 4/1989 | Swahlan | 49/49 X |
| 4,826,349 | 5/1989 | Nasatka | 404/6 |
| 4,828,424 | 5/1989 | Crisp, Sr. | 49/49 X |
| 4,850,737 | 7/1989 | Nasatka et al. | 404/6 |
| 4,893,119 | 1/1990 | Nasatka | 340/928 |
| 4,934,097 | 6/1990 | Quante | 49/49 |

*Primary Examiner*—Philip C. Kannan

*Attorney, Agent, or Firm*—Shlesinger, Arkwright & Garvey

[57] ABSTRACT

A vehicle barrier includes a barrier plate pivotally attached to a base support for movement between a horizontal non-operative position and an angularly operative position, a brace extending rearwardly from a pivotal support secured to a rear surface of the barrier plate and spaced from a barrier pivot disposed on a front of the base support, a brace stop device mounted on a rear of the base support, and operating mechanisms for raising and lowering the barrier gate and associated brace from horizontal non-operative positions to angularly operative positions and vice-versa. When the barrier plate is in its angularly operative position, a rear end of the brace abuts the brace stop device so that the brace is in an inclined position. The brace lies in a substantially horizontal plane and is out of engagement with the brace stop device when the barrier gate is in its horizontal non-operative position.

15 Claims, 3 Drawing Sheets

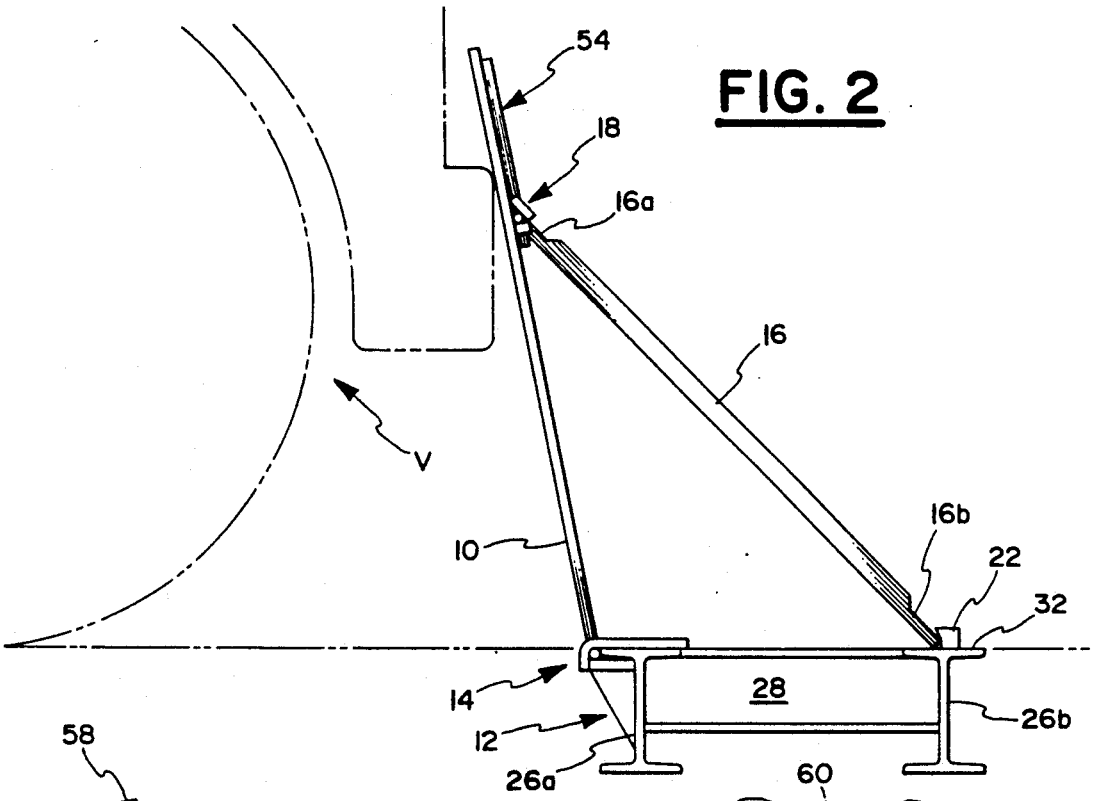
FIG. 2
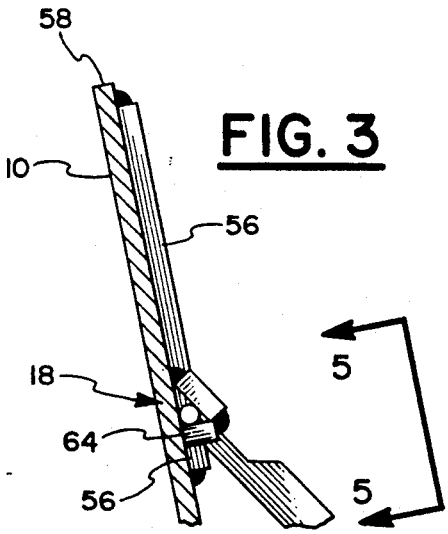
FIG. 3
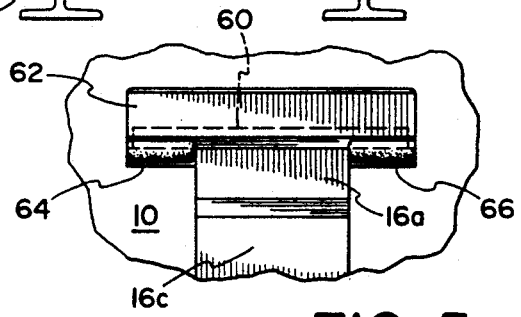
FIG. 5
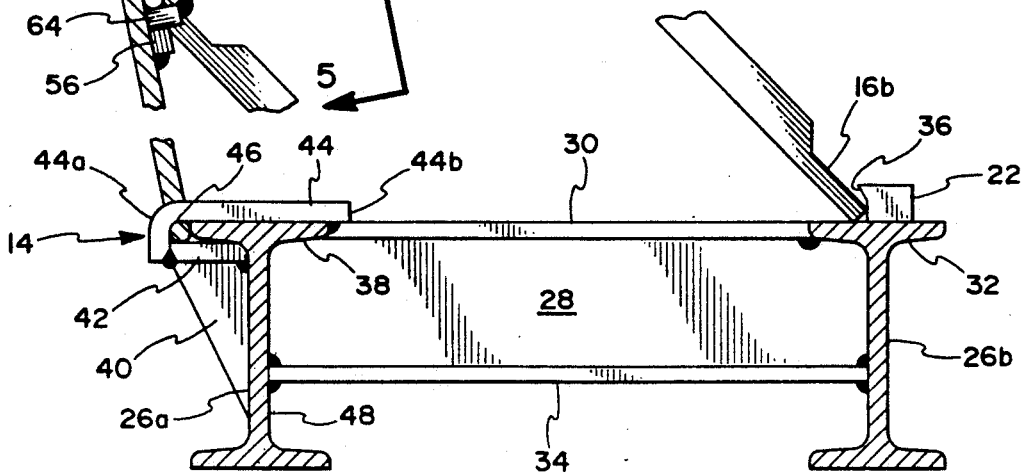

VEHICLE BARRIER

FIELD OF THE INVENTION

The present invention relates generally to a barrier for controlling the ingress and egress of vehicular traffic along a roadway and more particularly concerns a barrier having a gate which is quickly and easily moved from a non-operative position to an angularly operative position for preventing traffic flow.

BACKGROUND OF THE INVENTION

The prevention of unauthorized entry of vehicles to a facility has increased in importance in the recent past. Typically, a vehicle barricade is disposed across a roadway in order to control entry or exiting into or from a restricted facility. These barricades normally have a barrier plate which is pivotal between a first lowered position, permitting passage along the roadway, and a second raised position, preventing such passage. A hydraulic cylinder and piston assembly or other mechanical mechanism is normally employed to pivot the barrier plate between the non-operative lowered position and the operative raised position.

The inventor has developed several of these barricades; however, there are drawbacks to these security systems. In particular, U.S. Pat. Nos. 4,826,349 and 4,850,737 disclose an underground vehicle barricade having a barrier plate pivotally associated with frame means for being pivoted between a first position overlying the frame means and a second position disposed angularly upwardly relative to the frame means. Since the hydraulic operating mechanisms are located within the frame means, a rather large excavation is required to install such a vehicle barricade. Further, the hydraulic operating system is complex as a number of pivotal links are required.

Aboveground vehicle barricades are known as discussed in U.S. Pat. No. 4,850,737; but, elaborate support structures are required to absorb the impact forces caused by vehicle collisions with the barrier plate as shown in U.S. Pat. Nos. 4,574,523 and 4,630,395. Moreover, these known barricades tend to buckle when an oncoming vehicle crashes into the raised barrier plate.

Further, the hydraulically operated systems associated with the prior art employ either a single cylinder and piston assembly or a dual assembly system. Since conventional barrier plates are extremely large and thick in size, several thousand pounds of hydraulic pressure are necessary to pivotally move the barrier plate which can weight several thousand pounds. Since such high operating pressures are not desirable due to safety concerns and the added expense of special pumps or motors necessary to operate the hydraulic system, vehicle barricades have been constructed with a parallel, dual hydraulic system or a counterweight has been secured to a gate plate extending from the barrier plate to lessen the operating pressure of each hydraulic cylinder. However, the hydraulic operating pressure must be of a level sufficient to withstand the impact of a speeding vehicle. Thus, the reduction of hydraulic pressure has been limited.

Therefore, it can be seen that there is a need for a vehicle barricade or barrier which has a pivotal gate which is manufactured from a heavy gauge steel or other metal so that its mass is sufficient to withstand the impact of a speeding vehicle. Moreover, the vehicle barrier should be constructed so that the heavy gauge barrier gate can be moved between a non-operative position and an operative position with a minimum of effort. Likewise, the operating mechanisms should be simple and inexpensive to maintain but provide rapid pivoting of the barrier plate so that unauthorized vehicles can be stopped within a minimal amount of time.

OBJECTS AND SUMMARY OF THE INVENTION

A primary object of the invention is to provide a vehicle barrier having a barrier plate of substantial mass which may be rapidly pivoted between a non-operative position and an angularly disposed, operative position in response to a minimum of operating pressure.

It is an associated object of the invention to provide a vehicle barrier with a rapidly pivoting gate that can withstand the impact of a speeding vehicle (e.g., a truck moving at 55 mph) without buckling. Thus, a feature of the invention is that the barrier gate need not be replaced after each collision thereby reducing repair and maintenance costs.

Another object of the invention is to provide a vehicle barrier which does not require a substantial aboveground concrete support structure or substantial excavation of the roadway to install such a barrier.

An associated object of the invention is to provide an operating mechanism for such a vehicle barrier which can raise a barrier plate into its operative position in approximately 3–4 seconds utilizing a minimum pressure level.

It is a further object that the operating pressure of the operating mechanism can be increased to reduce the lifting time to approximately 1½ seconds or less. Thus, it is a feature of the invention to provide a vehicle barrier having flexible operating pressures so that the lifting time can be reduced for emergencies by increasing the minimum operating pressure.

The above objects are achieved by the vehicle barrier according to the present invention which includes a base support having pivot means disposed on its front and brace stop means mounted on its rear, a barrier gate pivotally attached to the support pivot means for movement between a horizontal non-operative position and an angularly operative position, barrier pivot means disposed on the barrier gate and spaced a substantial distance from the base support pivot means, a brace extending rearwardly from the barrier pivot means which lies in a substantially horizontal plane when the barrier gate is in its horizontal non-operative position and is in an inclined position abutting the brace stop means when the barrier gate is in its angularly operative position, and a device for raising and lowering the barrier gate from the horizontal non-operative position to the angular operative position and vice-versa.

BRIEF DESCRIPTION OF THE DRAWINGS

Other objects, features and advantages of the invention and a better understanding of its construction and operation will become apparent from the following description, taken in conjunction with the accompanying drawings in which:

FIG. 2 is an end view of a vehicle barrier in accordance with the invention illustrating the angularly operative position of the barrier gate and showing an impacting vehicle in phantom;

FIG. 3 is a section view, partially broken, taken along line 3—3 of FIG. 1;

FIG. 5 is a fragmentary, rear view of a barrier gate taken along line 5—5 of FIG. 3 and showing a pivotal connection of a brace according to the invention;

DESCRIPTION OF THE PREFERRED EMBODIMENT

Figure 1:
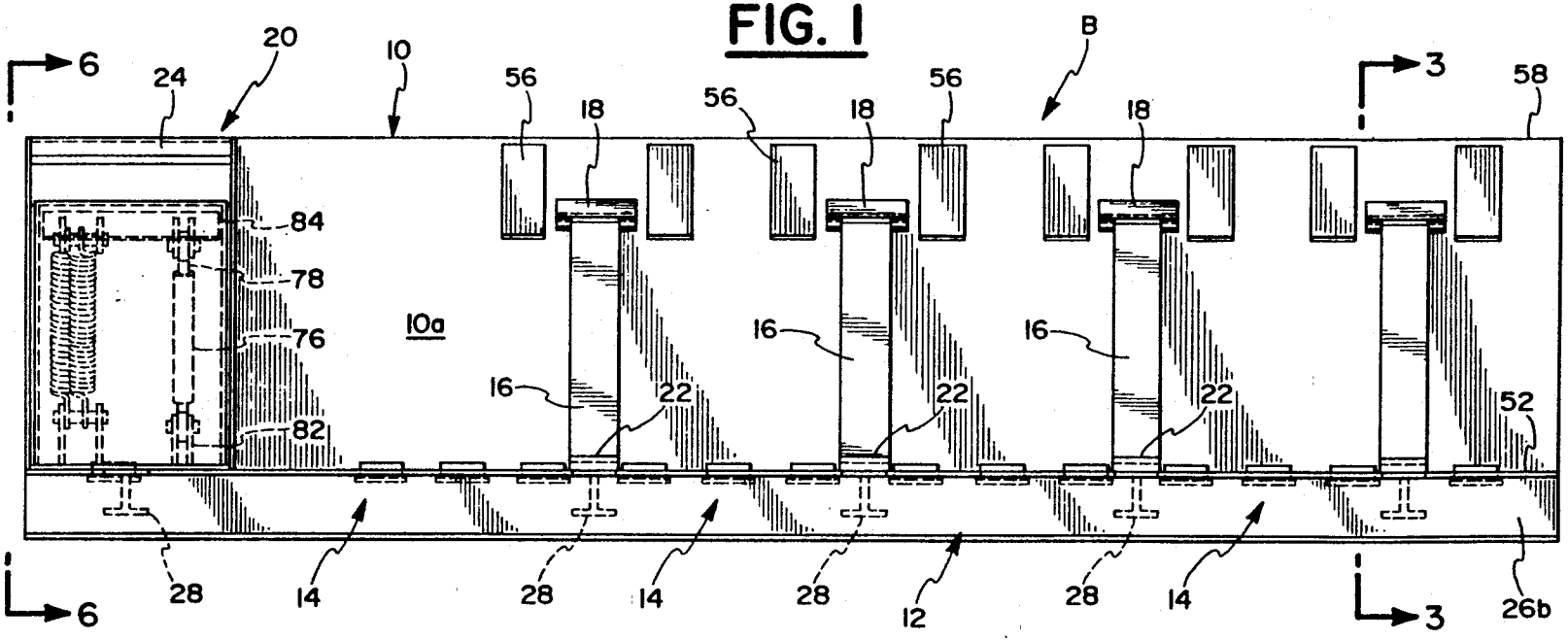
FIG. 1 is a rear elevational view of a vehicle barrier according to the invention in its operative position and showing the operating mechanisms and portions of the base support in hidden lines.

Referring to FIGS. 1 and 2, the general arrangement of a vehicle barrier B according to the invention may be seen to include a barrier gate 10 pivotally mounted on a base support 12 via a hinge assembly 14 for movement between a horizontal non-operative position and an angularly operative position (FIG. 2), a brace 16 extending rearwardly from a pivot support 18 secured to barrier gate 10 and spaced a substantial distance from hinge assembly 14, and operating mechanisms 20 for raising and lowering barrier gate 10 and its associated brace or plurality of braces 16.

Vehicle barrier B is intended for blocking a roadway, the approach ramp to an underground garage, a vehicle entrance to a building or other facility, and the like. The pivotal arrangement of barrier gate 10 enables vehicle barrier B to be used as a traffic control which allows authorized vehicles to pass when the installed barrier gate is in its horizontal position.

Likewise, vehicle barrier B can be actuated to quickly (3–4 seconds or less) raise barrier gate 10 into its angularly disposed, operative position for stopping and preventing the further movement of vehicles moving at speeds up to 55 mph. A brace stop means 22 securely fastened to base support 12 can be provided for holding brace 16 in an angular support position. The support provided by brace 16 can absorb impact forces and can be adapted so that barrier gate 10 can withstand collisions with vehicles weighing in excess of eight tons.

As shown in FIG. 1, a plurality of braces 16 can be mounted across barrier gate 10 at spaced intervals. In this embodiment, a plurality of spaced pivot supports 18 are disposed on a rear surface 10*a* of barrier gate 10 for pivotally securing upper ends 16*a* of respective braces 16. Preferably, the pivotal connection of braces 16 and pivot support 18 is such that braces 16 lie in a substantially horizontal plane when barrier gate 10 is in its horizontal non-operative position (see FIG. 7) to provide a minimum obstruction so that authorized vehicles can cross the lowered barrier gate. Similarly, brace 10 is in an inclined position which can be determined by the position of brace stop means 22 when barrier gate 10 is in its angularly operative position (see FIG. 2). In a preferred embodiment, a lower end 16*b* of brace 16 forms an angle of approximately 45° with upper flange 30 of cross beam 28.

Vehicle barrier B may further include a housing 24 which can be continguously disposed on one end of base support 12 for enclosing operating mechanisms 20. The end of base support 12 on which housing 24 is securely fastened to a roadway may be positioned alongside the roadway where traffic control is desired. Preferably, a front surface 24*a* of housing 24 faces barrier gate 10 (see FIG. 6) and housing 24 is welded or secured by other fastening means to base support 12.

Base Support Structure

In a preferred embodiment, base support 12 is constructed with two parallel I-beams 26*a*, 26*b* which respectively run across the front and rear of base support 12. The length of I-beams 26*a*, 26*b*, as well as the length of barrier plate 10, may be varied so that the same extends across the length of the roadway or other passageway where security is desired.

Base support 12 further may include a plurality of spaced cross beams 28 disposed between parallel I-beams 26*a*, 26*b* and secured via welding or the like to form a frame. The resultant frame of I-beams 26*a*, 26*b* and 28 can be embedded, preferably in concrete, across a roadway or the like to secure base support 12 to the roadway and to provide further support to withstand collision impacts. Preferably, cross beams 28 are fastened perpendicularly to I-beams 26*a*, 26*b* and are equally spaced along a portion of base support 12 to cooperate with braces 16 of barrier B. The lower ends 16*b* of braces 16 can then travel along an upper flange 30 of each cross beam 28 when barrier gate 10 pivots. As shown in FIG. 3, upper cross flange 30 and lower cross flange 34 of cross beam 28 may be secured to I-beams 26*a*, 26*b* via welding or other conventional means. Metal I-beams of a smaller size and length than that used for I-beams 26*a*, 26*b* can be used for cross beams 28.

Brace stop means 22 can be securely fastened along an upper flange 32 of rear I-beam 26*b* at spaced intervals which intersect with upper cross flanges 30 of cross beam 28. In a preferred embodiment, an elongated, cubelike metal block may form brace stop means 22. Additionally, brace stop means 22 may include an angular protrusion 36 which extends from a side of the cubelike stop means 22 which faces the pivotal barrier gate 10. Angular protrusion 36 together with upper flange 32 of I-beam 26*b* forms a recess for receiving and holding the lower end 16*b* of brace 16.

Hinge Assembly

Barrier gate 10 can be pivotally mounted on base support 12 via a plurality of hinge assemblies 14 mounted along an upper flange 38 of front I-beam 26*a*. Each hinge assembly 14 as shown in FIG. 3 may include a triangular gusset member 40, a lower shim 42, a curved upper shim 44 and a pivot pin 46 which may be welded to barrier gate 10.

Lower shim 42 can be securely fastened to an underside of upper flange 38 of front I-beam 26*a* via welding or other conventional means. Triangular gusset member 40 is secured via welding or other conventional means to lower shim 42 so that a leg of its triangle extends downwardly along mid-section 48 of front I-beam 26*a*. A curved front end 44*a* of curved upper shim 44 is shaped and positioned about upper front flange 38 so that an opening is formed when front end 44*a* is secured via welding or other conventional methods to lower shim 40. The resultant opening should be of a size sufficient to receive a pivot pin 46 about which barrier gate 10 pivots. Likewise, free end 44*b* of curved upper shim 44 is welded or secured by other conventional means to upper flange 38.

In a preferred embodiment, as shown in FIG. 1, a plurality of hinge assemblies 14 are spaced along an upper front of base support 12. Preferably, three hinge assemblies 14 should be disposed between each pair of braces 16 to further strengthen the pivotal arrangement of barrier gate 10 thereby enabling barrier B to withstand collision impacts of fast moving vehicles without pivot pins 46 being torn from the above-described hinge assembly 14. In the present form of the invention, the line of hinge assemblies 14 disposed about braces 16 does not extend across the entire barrier gate 10. This is because housing 24 is positioned to the side of the roadway and includes its own bracing mechanism as will be described below.

Figure 4B:
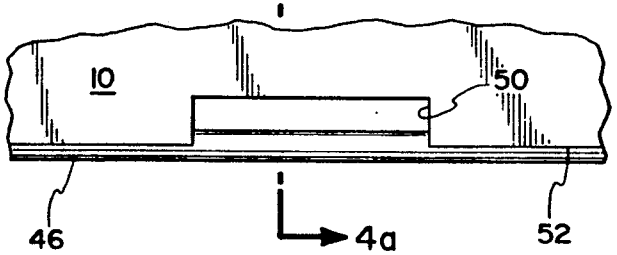
FIG. 4*b* is a cross sectional view taken along lines 4—4 of FIG. 4*a*.
Figure 4A:
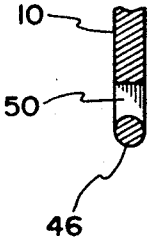
FIG. 4*a* is a breakaway view of a portion of a barrier gate according to the invention showing its hinge assembly.

A plurality of recesses 50, as illustrated in FIGS. 1 and 4*a*, 4*b* can be formed in a bottom edge 52 of barrier gate 10 through which curved upper shim 44 extends. Pivot pin 46 can be one elongated rod which is welded or secured to bottom edge 52 via other conventional means.

Barrier Gate Structure

Barrier gate 10 can be designed so that it has a height sufficient to stop a variety of unauthorized vehicles. For example, a heavy-duty barrier gate with a height sufficient to stop trucks or other heavy moving vehicles and a reinforced top surface 54 can be employed in areas desiring security from terrorists. While a barrier gate of a shorter height and without reenforcing plates 56 can be employed to stop the average passenger automobile. According to one embodiment of the invention, barrier pivot supports 18 are mounted on a rear surface 10*a* of barrier gate 10 approximately at the height of where a moving vehicle's bumper V will impact an angularly disposed barrier gate 10 in its operative position. A plurality of reinforcing plates 56 can be secured to the rear surface 10*a* of barrier gate 10 adjacent sides of barrier pivot support 18 and extend from below barrier pivot support 18 to a top edge 58 of barrier gate 10. As those having ordinary skill in the art can appreciate, other conventional means for reinforcing or strengthening the metal plate of barrier gate 10 can be used so that the upper edge 58 does not buckle upon a collision impact.

Brace Pivoting Structure

In an embodiment employing a plurality of braces 16, a plurality of associated barrier pivot supports 18 are spaced along barrier gate 10 so that the associated brace 16 cooperates with respective cross beam 28 and brace stop means 22 disposed at an end of base support 12. A preferred brace 16 has a pivot pin 60 formed on the upper end 16*a* of brace 16. Pivot pin 60 and its associated brace 16 are preferably of one piece unitary construction. The main section 16*c* of brace 16 is preferably thicker than the ends 16*a*, 16*b* of the brace so that main section 16*c* can absorb the impact forces. Additionally, brace 16 is preferably made from a metal material or other material having like mechanical strength and qualities.

A preferred pivot support 18 may be formed from an upper elongated plate 62, and spaced left and right side plates 64, 66 which are welded or securely fastened to rear surface 10*a* of barrier gate 10. Left and right plates 64, 66 are positioned so as to form a space for receiving an upper end 16*a* of brace 16 (see FIG. 5) and so that they extend substantially perpendicular to barrier gate 10 (see FIG. 3). Upper elongated plate 62 is welded to the free ends of plates 64, 66 at one side and to rear surface 10*a* at the other and is positioned at an angle forming an opening for receiving pivot pin 60 of brace 16.

Housing Structure

Figure 6:
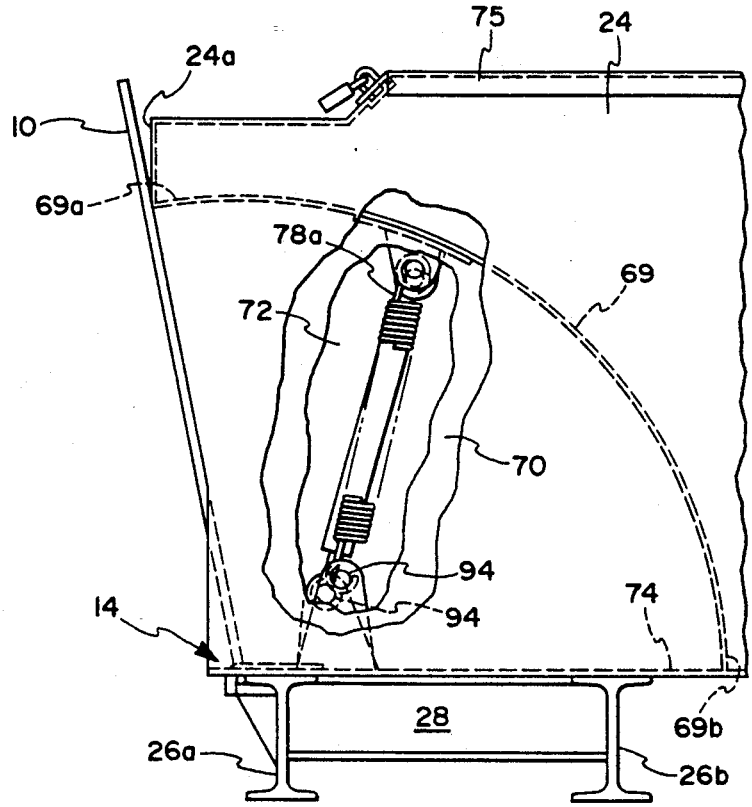
FIG. 6 is a side view showing the other end of the vehicle barrier taken along line 6—6 of FIG. 1 with the barrier gate in its angularly disposed operative position and a cut-out portion showing the inner structure of the operating mechanism.
Figure 7:
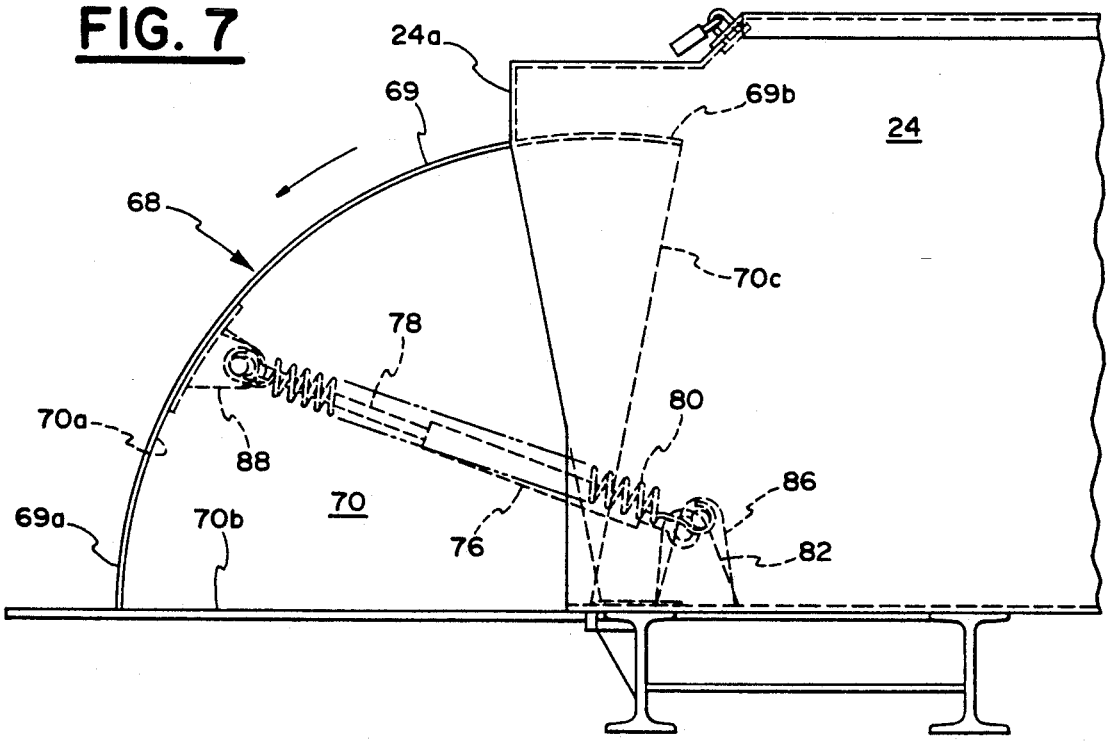
FIG. 7 is a view similar to that of FIG. 6 showing the barrier plate in its horizontal non-operative position with the operating mechanisms shown in hidden lines.

As shown in FIGS. 6 and 7, housing 24 is securely mounted on front and rear I-beams 26*a*, 26*b* and a cross beam 28 which runs underneath the mid section of housing 24 (see FIG. 1). A hinge assembly 14 is disposed in front of the cross beam 28 supporting housing 24. This hinge assembly pivotally joins barrier gate 10 with base support 12 on the housing side of barrier B.

An arcuate box section 68 serves as an inner housing which is movable with barrier gate 10 and which cooperates with housing 24 to enclose raising and lowering means 20. An opening is formed in front surface 24*a* for receiving arcuate box section 68 within housing 24 when barrier gate 10 rotates into its angularly disposed, operative position (see FIG. 6). When barrier gate 10 is in its horizontal, non-operative position, arcuate box section 68 encloses the operative mechanisms of raising and lowering means 20.

Arcuate box section 68 includes a curved cover plate 69 which forms an arc of a circle and first and second box plates 70, 72. As shown in FIG. 6, with respect to first box plate 70, each box plate has an arcuate edge 70*a* disposed along a respective side of curved cover plate 69. A front end 69*a* of curved cover portion 69 and a front edge 70*b* of each first and second box plates 70, 72 are secured to barrier gate 10 via welding or other conventional means. Thus, arcuate box section 68 has a front securely fastened to barrier gate 10 and rotates therewith. When barrier plate 10 is in its angularly operative position, a rear end 69*b* of curved cover plate 69 and the rear edge 70*c* of each first and second box plate 70, 72 abut a floor 74 of housing 24.

Additionally, a removable cover 75 can be provided for housing 24 to enable access to the inside of housing 24. Further, cover 75 can be locked via a conventional lock to keep unauthorized individuals from tampering with raising and lowering means 20.

Operative Mechanisms

The operative mechanisms of raising and lowering means 20 may include a cylinder 76 having a piston 78 for generating extension and retraction forces. Cylinder 76 and piston 78 preferably operate as a hydraulic assembly, but may be pneumatic or other force generating conventional mechanism. In addition, a spring 80 or other counterbalance means is provided to dampen extension forces causing barrier gate 10 to move into the horizontal, non-operative position.

The motor and pumps (not shown) for operating cylinder 76 and piston 78 are contained in housing 24 behind rotating arcuate box section 68. Moreover, conventional motors and pumps can be employed to control cylinder 76 and piston 78 for raising and lowering barrier gate 10.

In a preferred embodiment, cylinder 76 is mounted for pivotal movement on a support 82 secured to floor 74 of housing 24. A free end 78*a* of piston 78 is pivotally coupled to barrier gate 10 via a forked lug attached to curved cover plate 69 of arcuate box section 68. Likewise, one end of spring 80 is pivotally attached to a lower support 86 mounted on floor 74 of housing 24; while the other end of spring 80 is coupled to barrier gate 10 via an upper support 88 which is secured to curved cover plate 69 of arcuate box section 68. Up to three springs can be pivotally mounted to lower support 86 and upper support 88 to provide a sufficient retraction force for facilitating the pivoting of barrier gate 10 from the horizontal position to the angularly disposed position. Thus, if a heavy duty barrier gate 10 is being employed three heavy duty springs should be attached, in parallel with one another, to supports 86, 88.

Figure 8:
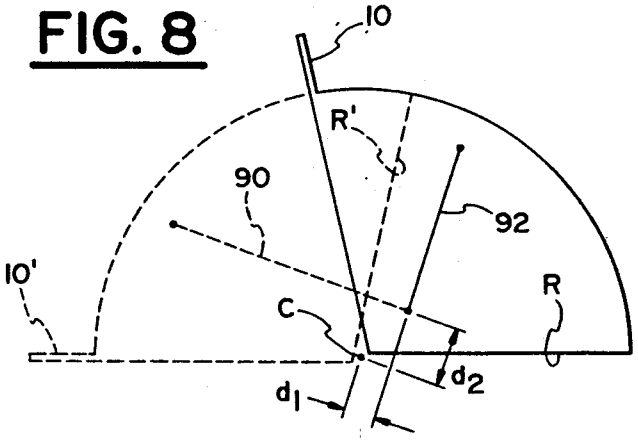
FIG. 8 is a schematic illustration of the operating forces on the barrier plate of FIGS. 6 and 7.

Referring to FIG. 8, which schematically illustrates the operating forces generated by cylinder 76 and piston 78 for pivoting barrier gate 10. The dashed lines 90, R′ represent the extension of piston 78 and cylinder 76, and arcuate box section 68, respectively when barrier gate 10′ is in its horizontal, non-operative position; while the solid lines 92, R represent the piston retraction and arcuate box section 68 in the operative position.

Point C represents the center of a circle formed by curved cover plate 69 of arcuate box section 68 as it pivots about pivot pin 46 of hinge assembly 14. Cylinder 76 is pivotally mounted a distance $d_1$ from center point C when fully retracted so that a moment can be created to rotate arcuate box section 68 and barrier gate 10 about pivot point C. Further, upon extension of piston 78 into the horizontal non-operative position, a second longer distance $d_2$ is formed in order to provide a greater force for holding barrier gate 10 down against the retracting force of spring 80. This structural arrangement allows piston 78 of cylinder 76 to pivot barrier gate 10 from its angularly disposed, operative position to its horizontal non-operative position with a minimum of force.

Further, as shown in FIGS. 6 and 7, lower supports 82, 86 of cylinder 76 and spring 80 each have a central opening 94. The central axes of openings 94 are offset from one another, but spring 80 and the assembly of cylinder 76 and piston 78 extend in respective parallel planes. As a result, a second, smaller moment can be created which enables the hydraulic pressure to be reduced further.

While this invention has been described as having a preferred design, it is understood that it is capable of further modifications, uses and/or adaptations following the general principles of the invention and including such departures from the present disclosure as come within known or customary practice in the art to which the present invention pertains, and as may be applied to central features hereinbefore set forth, and fall within the scope of the invention or the limits of the claims appended hereto.

I claim:

1. A vehicle barrier for roadways or the like comprising:

a) a base support having a front, a rear, support pivot means disposed on said front, and brace stop means mounted on said rear;

b) a barrier gate having front and rear surfaces, said barrier gate being pivotally attached to said support pivot means for movement between a horizontal not-operative position and an angularly operative position;

c) barrier pivot means disposed on said barrier gate and spaced a substantial distance from said support pivot means;

d) a brace extending from said barrier pivot means rearwardly thereof;

e) said brace lying in a substantially horizontal plane when said barrier gate is in said horizontal non-operative position and out of engagement with said brace stop means, and said brace being in an inclined position when said barrier gate is in said angularly operative position and a rear end of said brace abuts said stop means;

f) a housing disposed adjacent an end of said base support and having a front facing said barrier gate;

g) means for raising and lowering said barrier gate from said horizontal, non-operative position to said angularly operative position and vice-versa, said raising and lowering means being disposed within said housing;

h) said raising and lowering means including:

i) a cylinder having a piston for generating extension and retraction forces;

ii) said cylinder being mounted on a floor of said housing for pivotal movement;

iii) said piston having a free end pivotally coupled to said barrier gate;

iv) counterbalance means, said counterbalance means including a spring;

v) one end of said spring being attached to a support mounted on said floor of said housing; and vi) the other end of said spring being coupled to said barrier gate so that said spring dampens any extension force causing said barrier gate to move to said horizontal, non-operative position.

2. A vehicle barrier according to claim 1, wherein:

a) said barrier further comprises shroud means movable with said barrier gate for cooperating with said housing to enclose said raising and lowering means.

3. A vehicle barrier according to claim 2, wherein:

a) said shroud means includes an arcuate box section having a front secured to said barrier gate;

b) said other end of said spring and said free end of said piston are pivotally mounted to said arcuate box section for coupling to said barrier gate; and c) said housing further includes opening means formed in said housing front for receiving said arcuate box section within said housing.

4. A vehicle barrier according to claim 3, wherein:

a) said arcuate box section comprises a curved cover having front and rear ends and forming an arc of a circle, said cover front end being secured to said barrier gate; and b) said rear end of said curved cover abuts said housing floor when said barrier gate is in said angularly operative position.

5. A vehicle barrier according to claim 4, wherein:

a) said arcuate box section further comprises first and second box plates, each having an arcuate edge disposed along a respective side of said curved cover;

b) each box plate further having a front edge secured to said barrier gate and a rear edge which abuts said housing floor when said barrier gate is in its angularly operative position.

6. A vehicle barrier according to claim 4, wherein:

a) said support pivot means has a barrier gate pivot axis substantially located at the center of said circle;

b) said cylinder and said one end of said spring are mounted on individual bottom supports attached to said housing floor and spaced a distance from said barrier gate pivot axis; and c) said free end of said piston and said other end of said spring are mounted to respective top support lugs attached to said curved cover.

7. A vehicle barrier according to claim 6, wherein:

a) each said bottom support has a central opening having an axis offset from said other bottom support; and b) said cylinder and said one end of said spring pivot about their respective central axes.

8. A vehicle barrier according to claim 1, wherein:

a) said support pivot means comprises a rod and hinge means for movably holding said rod; and b) said barrier gate has a bottom edge with recess means for securing said rod to said barrier gate.

9. A vehicle barrier for roadways or the like comprising:

a) a base support having a front, a rear, support pivot means disposed on said front, and brace stop means mounted on said rear;

b) a barrier gate having front and rear surfaces, said barrier gate being pivotally attached to said support pivot means for movement between a horizontal non-operative position and an angularly operative position;

c) barrier pivot means disposed on said barrier gate and spaced a substantial distance from said support pivot means;

d) a brace extending from said barrier pivot means rearwardly thereof;

e) said brace lying in a substantially horizontal plane when said barrier gate is in said horizontal non-operative position and out of engagement with said brace stop means, and said brace being in an inclined position when said barrier gate is in said angularly operative position and a rear end of said brace abuts said stop means;

f) means for raising and lowering said barrier gate from said horizontal, non-operative position to said angularly operative position and vice-versa;

g) said support pivot means comprises a rod and hinge means for movably holding said rod;

h) said barrier gate has a bottom edge with recess means for securing said rod to said barrier gate;

i) a plurality of said rods and hinge means are spaced along said base support front; and j) said barrier gate has a plurality of recess means for receiving respective rods of said support pivot means.

10. A vehicle barrier according to claim 9, wherein:

a) said barrier pivot means are secured to said rear surface of said barrier gate.

11. A vehicle barrier according to claim 10, comprising:

a) a plurality of braces; and b) wherein a plurality of associated barrier pivot means and brace stop means are spaced along said barrier gate and base support, respectively.

12. A vehicle barrier according to claim 9, further comprising:

a) a reinforcing plate secured to said barrier gate rear surface.

13. A vehicle barrier for roadways or the like comprising:

a) a base support having a front, a rear, support pivot means disposed on said front, and brace stop means mounted on said rear;

b) a barrier gate having front and rear surfaces, said barrier gate being pivotally attached to said support pivot means for movement between a horizontal non-operative position and an angularly operative position;

c) barrier pivot means disposed on said barrier gate and spaced a substantial distance from said support pivot means;

d) a brace extending from said barrier pivot means rearwardly thereof;

e) said brace lying in a substantially horizontal plane when said barrier gate is in said horizontal non-operative position and out of engagement with said brace stop means, and said brace being in an inclined position when said barrier gate is in said angularly operative position and a rear end of said brace abuts said stop means;

f) means for raising and lowering said barrier gate from said horizontal, non-operative position to said angularly operative position and vice-versa;

g) said barrier pivot means are secured to said rear surface of said barrier gate;

h) a plurality of braces;

i) a plurality of associated barrier pivot means and brace stop means are spaced along said barrier gate and base support, respectively;

j) a plurality of reinforcing plates secured to said barrier gate rear surface; and k) said reinforcing plates being disposed adjacent sides of said barrier pivot means and extending between a bottom edge of said barrier pivot means and a top edge of said barrier gate.

14. A vehicle barrier according to claim 13, wherein:

a) said base support comprises a plurality of beam means forming a frame.

15. A vehicle barrier according to claim 14, wherein:

a) a housing is disposed adjacent an end of said base support, said housing having a front facing said barrier gate;

b) said raising and lowering means is disposed within said housing; and c) said housing further includes an access door for servicing said raising and lowering means.

* * * * *